US008446140B2

(12) United States Patent
Harvey

(10) Patent No.: US 8,446,140 B2
(45) Date of Patent: May 21, 2013

(54) CIRCUITS AND METHODS TO PRODUCE A BANDGAP VOLTAGE WITH LOW-DRIFT

(75) Inventor: Barry Harvey, Los Altos, CA (US)

(73) Assignee: Intersil Americas Inc., Milpitas, CA (US)

( * ) Notice: Subject to any disclaimer, the term of this patent is extended or adjusted under 35 U.S.C. 154(b) by 270 days.

(21) Appl. No.: 12/717,052

(22) Filed: Mar. 3, 2010

(65) Prior Publication Data

US 2011/0127987 A1 Jun. 2, 2011

Related U.S. Application Data

(60) Provisional application No. 61/265,303, filed on Nov. 30, 2009.

(51) Int. Cl.
*G05F 3/16* (2006.01)

(52) U.S. Cl.
USPC ..... 323/313; 323/311; 327/539

(58) Field of Classification Search
USPC ..... 323/312–316, 317; 327/538, 539
See application file for complete search history.

(56) References Cited

U.S. PATENT DOCUMENTS

| | | | | |
|---|---|---|---|---|
| 4,952,866 | A | 8/1990 | Van Tujil | |
| 5,440,254 | A | 8/1995 | Sundby | |
| 5,519,354 | A | 5/1996 | Audy | |
| 5,619,122 | A | 4/1997 | Kearney et al. | |
| 5,796,280 | A | 8/1998 | Tuozzolo | |
| 5,982,221 | A | 11/1999 | Tuthill | |
| 6,008,685 | A | 12/1999 | Kunst | |
| 6,019,508 | A | 2/2000 | Lien | |
| 6,037,832 | A | 3/2000 | Kaminishi | |
| 6,060,874 | A * | 5/2000 | Doorenbos | 323/316 |
| 6,157,244 | A | 12/2000 | Lee et al. | |
| 6,288,664 | B1 | 9/2001 | Swanson | |
| 6,407,622 | B1 | 6/2002 | Opris | |
| 6,501,256 | B1 | 12/2002 | Jaussi et al. | |
| 6,507,179 | B1 | 1/2003 | Jun et al. | |
| 6,549,065 | B2 | 4/2003 | Opris | |
| 6,554,469 | B1 | 4/2003 | Thomson et al. | |
| 6,642,778 | B2 | 11/2003 | Opris | |
| 6,736,540 | B1 | 5/2004 | Sheehan et al. | |
| 6,890,097 | B2 | 5/2005 | Tanaka | |
| 6,914,475 | B2 | 7/2005 | Enriquez et al. | |

(Continued)

OTHER PUBLICATIONS

1 Office Action for U.S. Appl. No. 12/111,796, issued Jul. 14, 2010.

(Continued)

*Primary Examiner* — Adolf Berhane
*Assistant Examiner* — Gustavo Rosario Benitez
(74) *Attorney, Agent, or Firm* — Vierra Magen Marcus LLP

(57) ABSTRACT

In accordance with an embodiment of the present invention, a bandgap voltage reference circuit includes a group of X current sources, a plurality of circuit branches, and a plurality of switches. Each of the X current sources (where X≧3) produces a corresponding current that is substantially equal to the currents produced by the other current sources within the group. The plurality of circuit branches of the bandgap voltage reference circuit are collectively used to produce a bandgap voltage output (VGO). Each of the plurality of circuit branches receives at least one of the currents not received by the other circuit branches. The plurality of switches (e.g., controlled by a controller) selectively change over time which of the currents produced by the current sources are received by which of the plurality of circuit branches of the bandgap voltage reference circuit.

19 Claims, 7 Drawing Sheets

U.S. PATENT DOCUMENTS

| | | | | |
|---|---|---|---|---|
| 6,957,910 | B1 | 10/2005 | Wan et al. | |
| 7,083,328 | B2 | 8/2006 | Johnson | |
| 7,164,259 | B1 | 1/2007 | Megaw et al. | |
| 7,170,334 | B2 | 1/2007 | Miranda et al. | |
| 7,193,543 | B1 | 3/2007 | McLeod et al. | |
| 7,236,048 | B1 | 6/2007 | Holloway et al. | |
| 7,281,846 | B2 | 10/2007 | McLeod | |
| 7,309,157 | B1 | 12/2007 | Aslan et al. | |
| 7,312,648 | B2 | 12/2007 | Yang | |
| 7,321,225 | B2 | 1/2008 | Garlapati et al. | |
| 7,341,374 | B2 | 3/2008 | Chiu | |
| 7,368,973 | B2 | 5/2008 | Sato | |
| 7,372,244 | B2 * | 5/2008 | Marinca | 323/316 |
| 7,420,359 | B1 | 9/2008 | Anderson et al. | |
| 7,579,860 | B2 | 8/2009 | Deken | |
| 7,724,075 | B2 | 5/2010 | Yang et al. | |
| 7,786,792 | B1 * | 8/2010 | Gay | 327/539 |
| 7,880,459 | B2 | 2/2011 | Harvey | |
| 2005/0001605 | A1 | 1/2005 | Marinca | |
| 2006/0255787 | A1 | 11/2006 | Schaffer et al. | |
| 2007/0152740 | A1 | 7/2007 | Georgescu et al. | |
| 2007/0252573 | A1 * | 11/2007 | Tachibana et al. | 323/313 |
| 2008/0095213 | A1 | 4/2008 | Lin et al. | |
| 2008/0278137 | A1 * | 11/2008 | Harvey | 323/311 |
| 2009/0146730 | A1 * | 6/2009 | Chen | 327/539 |
| 2010/0002748 | A1 | 1/2010 | Lin et al. | |

OTHER PUBLICATIONS

K. Kujik, "A Precision Reference Voltage Source," IEEE J. Solid State Circuits, vol. SC-8, Jun. 1973, pp. 222-226.

B. Song, et al., "A Precision Curvature-compensated CMOS Bandgap Reference," IEEE J. Solid State Circuits, vol. SC-18, Dec. 1983, pp. 634-643.

M. Tuthill, "A Switched-current, Switched-capacitor Temperature Sensor in 0.6 um CMOS," IEEE J. Solid State Circuits, vol. SC-33, Jul., 1998, pp. 1117-1122.

M. Pertijs, et al., "A cmos Smart Temperature Sensor with a 3 Sigma Inaccuracy of +/-0.5 deg C from—50 to 120 deg C," IEEE J. Solid State Circuits, vol. SC-40, Feb. 2005, pp. 454-461.

M. Pertijs, et al., "A cmos Smart Temperature Sensor with a 3 sigma Inaccuracy of +/-0.1 deg C from—55 to 125 deg C," IEEE J. Solid State Circuits, vol. SC-40, Dec. 2005, pp. 2805-2815.

J. Huijsing, et al., "Analog Circuit Design", Boston/Dordrecht/London: Kluwer Academic, 1996,pp. 263, 350-351.

M. Pertijs, et al. "A High-Accuracy Temperature Sensor with Second-order Curvature Correction and Digital Bus Interface", in Proc. ISCAS, May 2001, pp. 368-371.

P. Malcovati,et al., "Curvature-Compensated BiCMOS Bandgap with 1-V Supply Voltage," IEEE J. Solid state Circuits, vol. 36, No. 7 Jul. 2001, pp. 1076-1081.

Office Action in U.S. Appl. No. 12/718,840 dated Jun. 13, 2012.

Office Action in U.S. Appl. No. 12/718,840 dated May 30, 2012.

Pease, Robert A., National Semiconductor, "The Design of Band-Gap Reference Circuits: Trials and Tribulations," http://www.nationa.com/rap/Application/0,1570.24.00.html (1 of 12)Jan. 25, 2008 12:28:40 PM, 12 pages.

* cited by examiner

CIRCUITS AND METHODS TO PRODUCE A BANDGAP VOLTAGE WITH LOW-DRIFT

PRIORITY CLAIM

This application claims priority under 35 U.S.C. 119(e) to U.S. Provisional Application No. 61/265,303, filed Nov. 30, 2009, entitled CIRCUITS AND METHODS TO PRODUCE A BANDGAP VOLTAGE WITH LOW-DRIFT, which is incorporated herein by reference.

BACKGROUND

A bandgap voltage reference circuit can be used, e.g., to provide a substantially constant reference voltage for a circuit that operates in an environment where the temperature fluctuates. A bandgap voltage reference circuit typically adds a voltage complimentary to absolute temperature (VCTAT) to a voltage proportional to absolute temperature (VPTAT) to produce a bandgap reference output voltage (VGO). The VCTAT is typically a simple diode voltage, also referred to as a base-to-emitter voltage drop, forward voltage drop, base-emitter voltage, or simply VBE. Such a diode voltage is typically provided by a diode connected transistor (i.e., a BJT transistor having its base and collector connected together). The VPTAT can be derived from one or more VBE, where ΔVBE (delta VBE) is the difference between the VBEs of BJT transistors having different emitter areas and/or currents, and thus, operating at different current densities.

FIG. 1A illustrates an exemplary conventional bandgap voltage reference circuit 100, including transistors Q1 through QN connected in parallel (in the "N" branch), a transistor QN+1 (in the "1" branch), and a further transistor QN+2 (in the "CTAT" branch).

The bandgap voltage reference circuit 100 also includes an amplifier 120 and three PMOS transistors M1, M2 and M3 that are configured to function as current sources that supply currents to the "N", "1", and "CTAT" branches. Since the gates of the PMOS transistors are tied together, and their source terminals are all connected to the positive voltage rail (VDD), the source-to-gate voltages of these transistors are equal. As a result, the "N", "1", and "CTAT" branches receive and operate at approximately the same current, Iptat.

In FIG. 1A the transistor QN+2 is used to generate the VCTAT, and the transistors Q1 through QN in conjunction with transistor QN+1 are used to generate the VPTAT. More specifically, the VCTAT is a function of the base emitter voltage (VBE) of diode connected transistor QN+2, and the VPTAT is a function of ΔVBE, which is a function of the difference between the base-emitter voltage of transistor QN+1 and the base-emitter voltage of diode connected transistors Q1 through QN connected in parallel.

Due to negative feedback, the amplifier 120 adjusts the common PMOS gate voltage of current source transistors M1, M2 and M3 until the non-inverting (+) and inverting (−) inputs of the amplifier 120 are at equal voltage potentials. This occurs when Iptat*R1+$VBE_{1,2\ldots,n}$=$VBE_{n+1}$, where $VBE_{1,2,\ldots,n}$=$VBE_{n+1}$−ΔVBE. Thus, Iptat=ΔVBE/R1.

Here, the bandgap voltage output (VGO) is as follows:

$$VGO = VCTAT + VPTAT$$

$$= VBE + R2/R1 * V_T * \ln(N).$$

where $V_T$ is the thermal voltage, which is about 26 mV at room temperature.

If VBE~0.7V, and R2/R1*$V_T$*ln(N)~0.5V, then VGO~1.2V.

The current sources can be implemented using alternative configurations than shown in FIG. 1A. Accordingly, FIG. 1B is provided to show the more general circuit. As was the case in FIG. 1A, in FIG. 1B the amplifier 120 controls the current sources $I_1$, $I_2$ and $I_3$.

In practice, the long-term drift of the current sources causes drift in the bandgap voltage output (VGO), which is undesirable.

In particular, a change in $I_1$ causes an output VGO change of $$\Delta VGO = -\frac{\Delta I}{I} V_T\left(1 + \frac{R_2}{R_1} + 1/\ln(N)\right) + \Delta IR2.$$

A similar change in current from $I_2$ causes an output change of $$\Delta VGO = -Vt\frac{\Delta I}{I}\left(\frac{R_2}{R_1} + 1/\ln(N)\right).$$

A change in $I_3$ produces $$\Delta V_{GO} = \Delta IR_2 + \frac{\Delta I}{I} V_T.$$

Additionally, bandgap voltage reference circuits generate noise, a strong component of which is 1/F noise (sometimes referred to as flicker noise), which is related to the base current. It is desirable to reduce 1/F noise.

SUMMARY

Certain embodiments of the present invention are directed to bandgap voltage reference circuits that reduce the affects that long term drift of current sources have on the bandgap voltage output (VGO) produced by the bandgap voltage reference circuits.

In accordance with an embodiment of the present invention, a bandgap voltage reference circuit includes a group of X current sources, a plurality of circuit branches, and a plurality of switches. Each of the X current sources (where X≧3) produces a corresponding current that is substantially equal to the currents produced by the other current sources within the group. The plurality of circuit branches of the bandgap voltage reference circuit are collectively used to produce a bandgap voltage output (VGO). Each of the plurality of circuit branches receives at least one of the currents not received by the other circuit branches. The plurality of switches (e.g., controlled by a controller) selectively change over time which of the currents produced by the current sources are received by which of the plurality of circuit branches of the bandgap voltage reference circuit. This reduces the affects that the long-term drift of the current sources have on the bandgap voltage output (VGO), thereby making the bandgap voltage output (VGO) more stable. Additionally, this reduces the 1/F noise.

In accordance with an embodiment, at any given time, at least one of the currents produced by at least one of the current sources is not received by any of the circuit branches which are collectively used to produce the bandgap voltage output (VGO), even though at other times the current(s) produced by such current source(s) is/are received by the circuit branches which are collectively used to produce the bandgap voltage output (VGO).

Embodiments of the present invention are also directed to methods for use with bandgap reference circuits that produce a bandgap voltage output (VGO), where the bandgap voltage reference circuit include a plurality of circuit branches that are collectively used to produce the bandgap voltage output (VGO). In accordance with an embodiments, such a method includes using each current source of a group of X current sources (where X≧3) to produce a corresponding current that is substantially equal to the currents produced by the other current sources within the group. The method also includes selectively changing over time which of the currents produced by the current sources are received by which of the circuit branches of the bandgap voltage reference circuit that are collectively used to produce the bandgap voltage output (VGO).

In accordance with an embodiment, a method includes controlling the selectively changing such that the current produced by each of the X current sources is received about 1/Xth of the time by each of the plurality of circuit branches that are collectively used to produce the bandgap voltage output (VGO).

Embodiments of the present invention are also directed to voltage regulators that include a bandgap voltage reference circuit, such as the one described above, but not limited thereto. The voltage regulators can be, e.g., fixed output or adjustable output linear voltage regulators, but are not limited thereto.

This summary is not intended to summarize all of the embodiments of the present invention. Further and alternative embodiments, and the features, aspects, and advantages of the embodiments of invention will become more apparent from the detailed description set forth below, the drawings and the claims.

DETAILED DESCRIPTION

As mentioned above in the discussion of FIGS. 1A and 2A, the long-term drift of the current sources of a bandgap voltage reference circuit cause drift in the bandgap voltage output (VGO), which is undesirable. Embodiments of the present invention described herein reduce such long-term drift, as will be described with reference to FIGS. 2A and 2B. Embodiments of the present invention can also reduce 1/F noise.

Figure 2A:
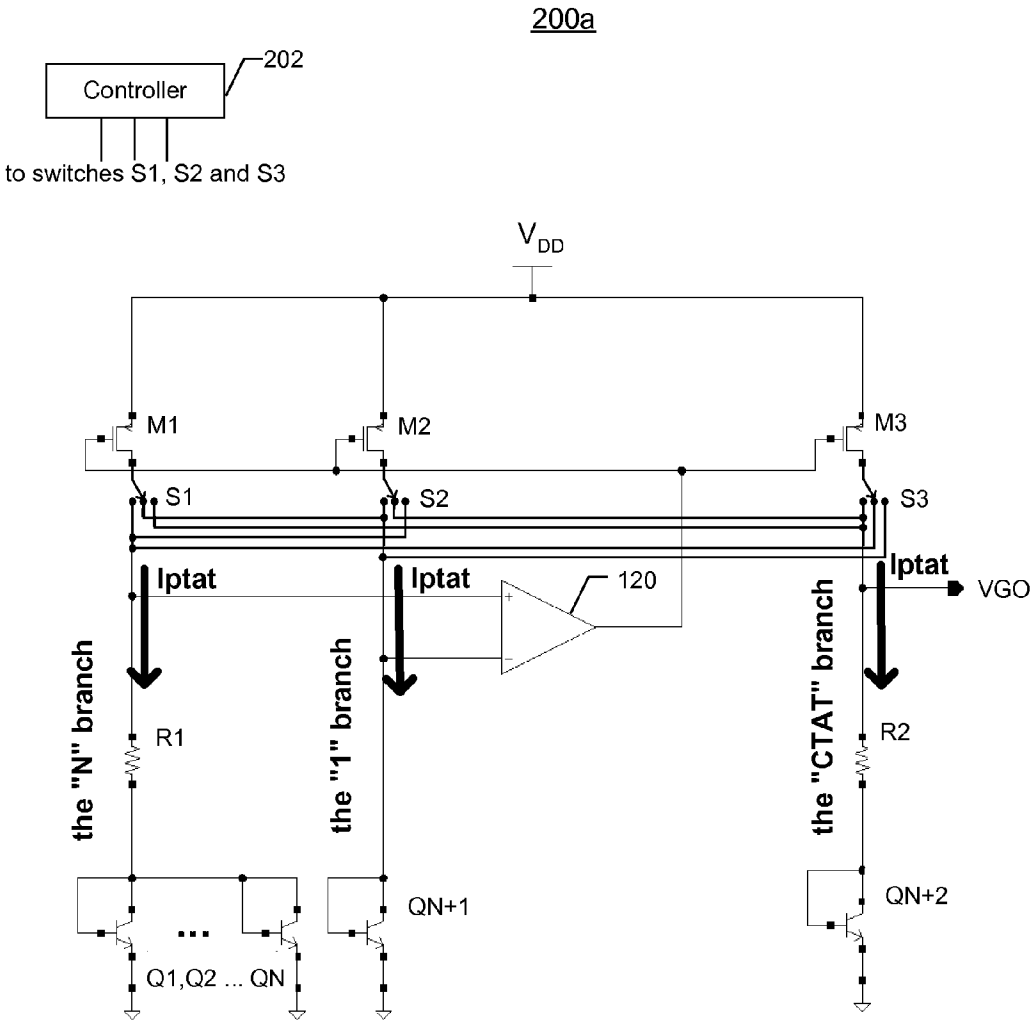
FIGS. 2A and 2B illustrate low-drift bandgap voltage reference circuits according to exemplary embodiments of the present invention.
Figure 2B:
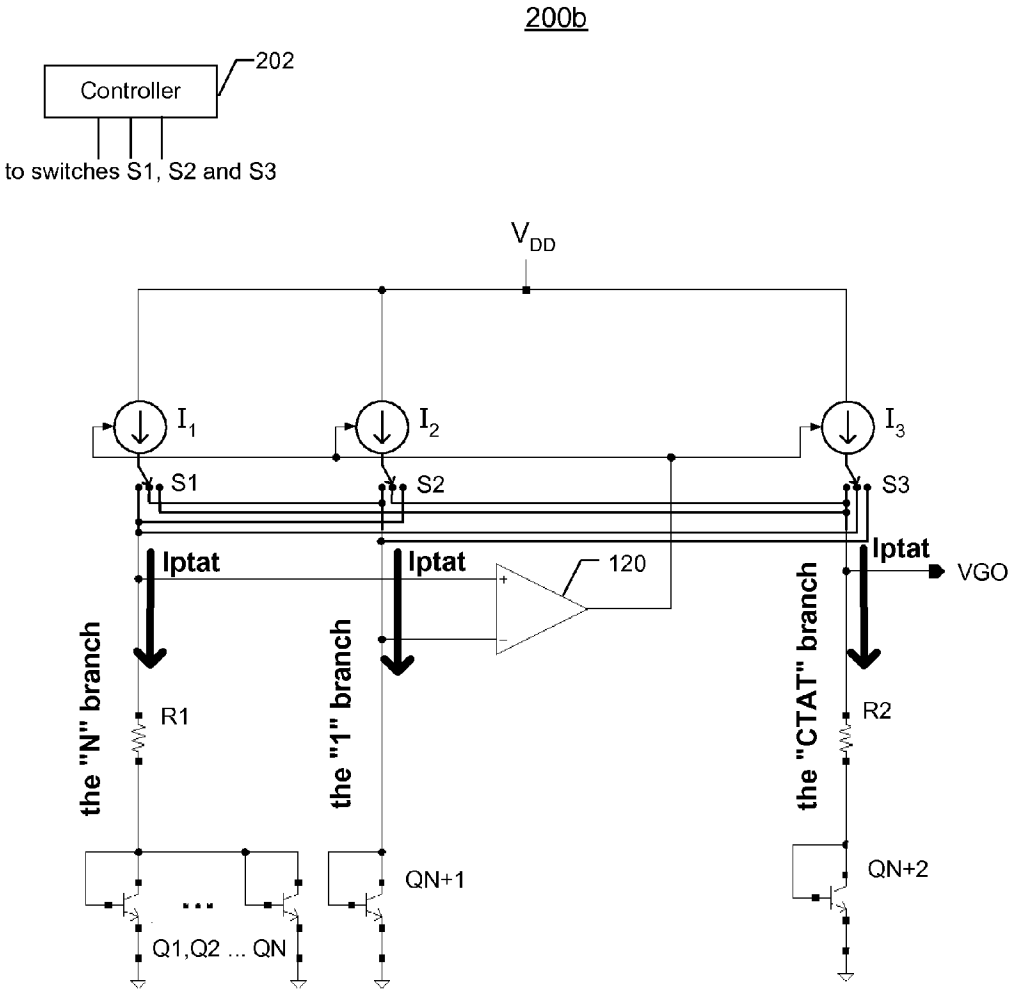

In accordance with an embodiment of the present invention, the three current sources in FIGS. 2A and 2B effectively shift position such that each current source spends $1/3^{rd}$ of the time at each position (i.e., in each branch). Stated another way, the current produced by each of the current sources is received by each of the three circuit branches shown in FIGS. 2A and 2B $1/3^{rd}$ of the time.

In this embodiment, ΔI will create ΔVGOs as the sum of all these disturbance equations, divided by 3. Adding them yields an average output disturbance of $$\Delta VGO, avg = \frac{1}{3} * \frac{\Delta I}{I} V_T\left(1 - \frac{V_T}{IR_1}\right).$$

$IR_1 = V_T$ in N in the normal operation of the ΔVBE loop. N is commonly 8, although it can be various alternative values, which are within the scope of the embodiments of the present invention.

For $$N = 8, \Delta VGO, avg = \frac{1}{3} * \frac{\Delta I}{I} V_T\left(1 - \frac{1}{\ln N}\right) = 0.017\frac{\Delta I}{I} V_T.$$

For $$N = 8, \frac{R_2}{R_1} \approx 9.3$$

to produce $V_{GO}$ with a good temperature coefficient (tempco).

If $I_1$ had a disturbance ΔI and the current sources were not rotated, then $$\Delta VGO = \frac{\Delta I}{I} V_T\left(1 + \frac{R_2}{R_1}\right) = 10.3\frac{\Delta I}{I} V_T.$$

Thus, by rotating the current sources, in accordance with an embodiment of the present invention, the $I_1$'s drift effect on VGO can be improved (i.e., reduced) by a factor of 59. Rotating the current sources reduces $I_2$'s drift effect on VGO by a factor of 116, and reduces $I_3$'s drift effect on VGO by a factor of 60.

Figure 1A:
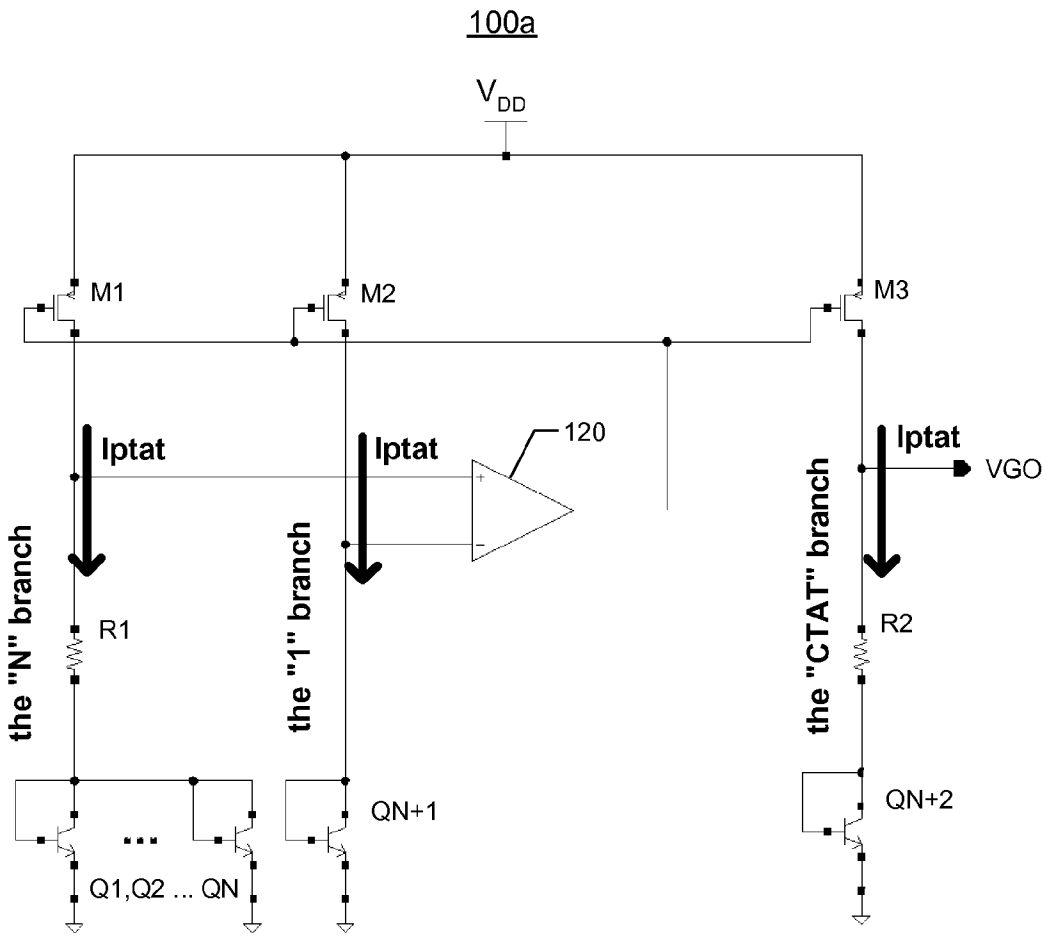
FIG. 1A (prior art)
FIGS. 1A and 1B illustrate exemplary conventional bandgap voltage reference circuits.
Figure 1B:
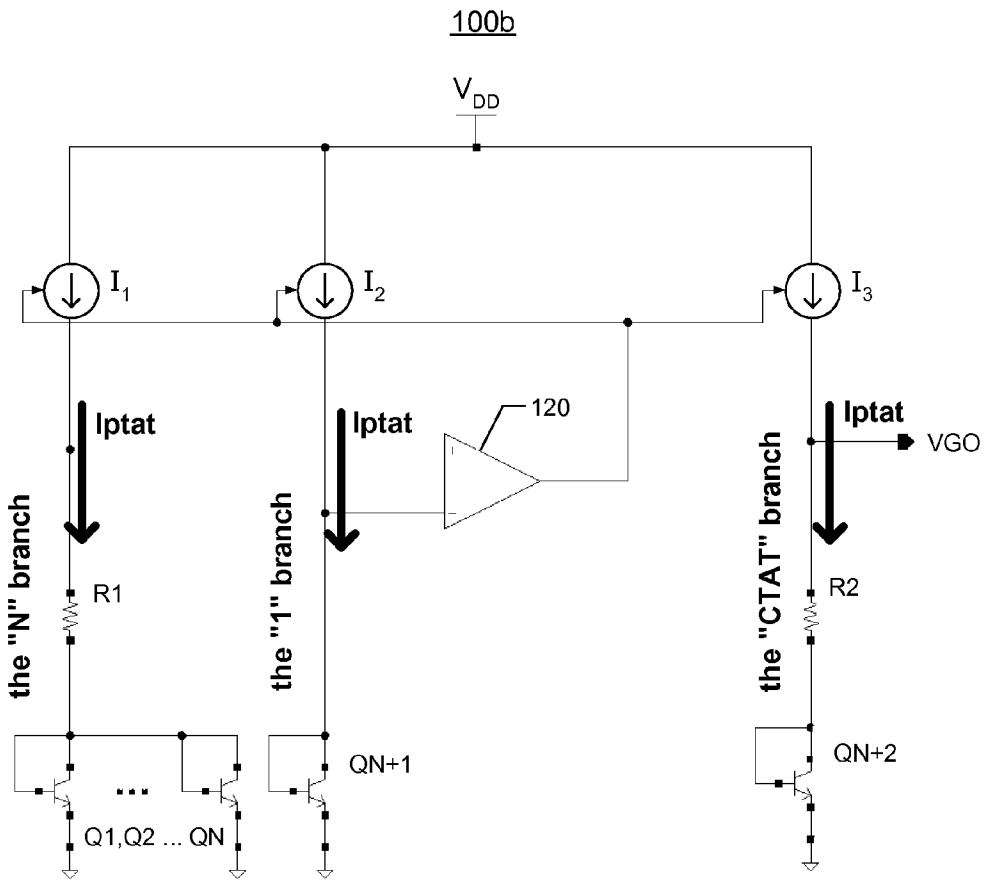
FIG. 1B (prior art)

FIG. 2A illustrates how the bandgap voltage reference circuit of FIG. 1A can be modified, in accordance with an embodiment of the present invention, to effectively rotate the current sources to achieve the improvements just described above. FIG. 2B illustrates how the more general bandgap voltage reference circuit of FIG. 1B can be modified, in accordance with an embodiment of the present invention, to rotate the current sources.

In FIGS. 2A and 2B, a controller 202 controls with switches S1, S2 and S3 to change which current source is providing its current to which branch of the bandgap voltage reference circuits 200*a* and 200*b*. In accordance with an embodiment of the present invention, the switches are controlled such that the three current sources provide a current to each of the branches $1/3^{rd}$ of the time. In accordance with an embodiment, the switches are controlled in a cyclical manner.

In accordance with another embodiment, the switches are controlled in a random or pseudo-random manner.

In FIGS. 2A and 2B each switch is shown as a single-pole-triple-throw switch, but embodiments of the present invention are not limited thereto. For example, in place of each single-pole-triple-throw switch, a three single-pole-single-throw switches can be used, but three such switches will still be referred to collectively as a switch. The switches can be implemented, e.g., using CMOS transistors, but are not limited thereto. The controller 202 can be implemented by a simple counter, a state machine, a micro-controller, or a processor, but is not limited thereto.

In accordance with certain embodiments, there can be more current sources than branches in the bandgap reference voltage circuit. For a specific example, there can be more than three current sources. In some such embodiments, at any given time, at least one of the currents produced by at least one of the current sources is not received by any of the circuit branches which are collectively used to produce the bandgap voltage output (VGO). However, at other times the current(s) produced by the same current sources is/are received by the circuit branches which are collectively used to produce the bandgap voltage output (VGO). The current(s) not used to produce VGO (i.e., the current(s) produced by the current source(s) temporarily switched out of the bandgap voltage reference circuit) can be sunk to ground, provided to one or more other circuit, or used in some other manner.

Referring to FIG. 2A, the additional current source(s) can be provided, e.g., by connecting additional PMOS transistor(s) in parallel with M1, M2 and M3, and having the added current source(s) also biased by the output of the amplifier 120. Additional switches and alternative switch functionality may also be required. For example, if there are six current sources, then each switch may be a single-pole-six-throw switch, as opposed to a single-pole-triple-throw switch, as would be apparent to one of ordinary skill in the art reading this description.

In certain embodiments, more than one current source at a time can be used to provide currents to the same branch of the bandgap voltage reference circuit. For example, with nine current sources, three currents sources can be provide their currents to the "1" branch, three current sources can provide their currents to the "N" branch, and three current sources can provide their currents to the "CTAT" branch. In such embodiments, at any given time each of the three branches still preferably receives at least one of the currents not received by the other two circuit branches. Further, in such embodiments the switches are still used to selectively change over time which of the currents are received by which of the branches of the bandgap voltage reference circuit. Even further current sources can be provided. For example, with eighteen currents sources, at any given time three current sources can provide their currents to the "1" branch, three current sources can provide their currents to the "N" branch, three current sources can provide their current to the "CTAT" branch, and nine current sources can be temporarily switched outside the bandgap voltage reference circuit (e.g., at which time their currents are sunk to ground, provided to one or more other circuits, or used in some other manner). These are just a few examples, which are not meant to be all encompassing and limiting.

Figure 3:
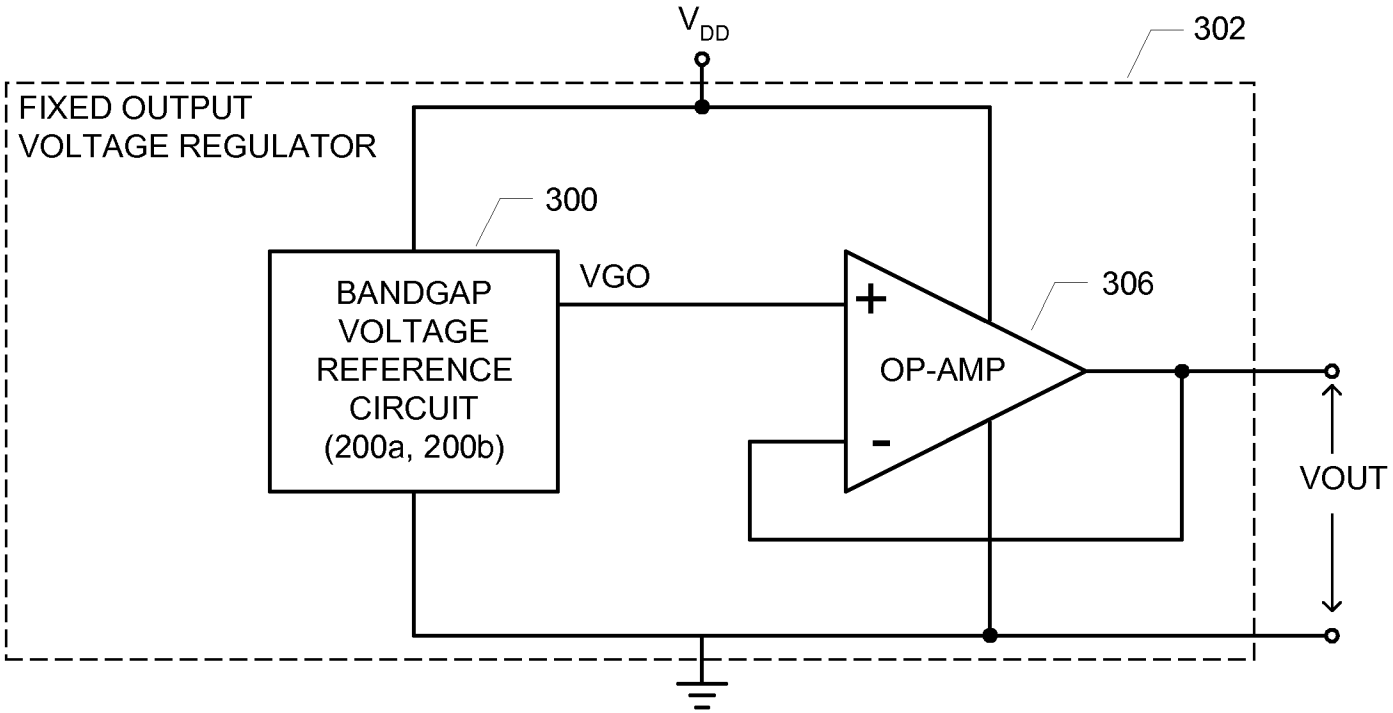
FIG. 3 is a block diagram of an exemplary fixed output linear voltage regulator that includes a low-drift bandgap voltage reference circuit according to an embodiment of the present invention.

FIG. 3 is a block diagram of an exemplary fixed output linear voltage regulator 302 that includes a low-drift bandgap voltage reference circuit 300 according to an embodiment of the present invention described above (e.g., 200*a*, 200*b*). The bandgap voltage reference circuit 300 produces a bandgap voltage output (VGO), which is provided to an input (e.g., a non-inverting input) of an operational-amplifier 306, which is connected as a buffer. The other input (e.g., the inverting input) of the operation-amplifier 306 receives an amplifier output voltage (VOUT) as a feedback signal. The output voltage (VOUT), through use of the feedback, remains substantially fixed, +/−a tolerance (e.g., +/−1%).

Figure 4:
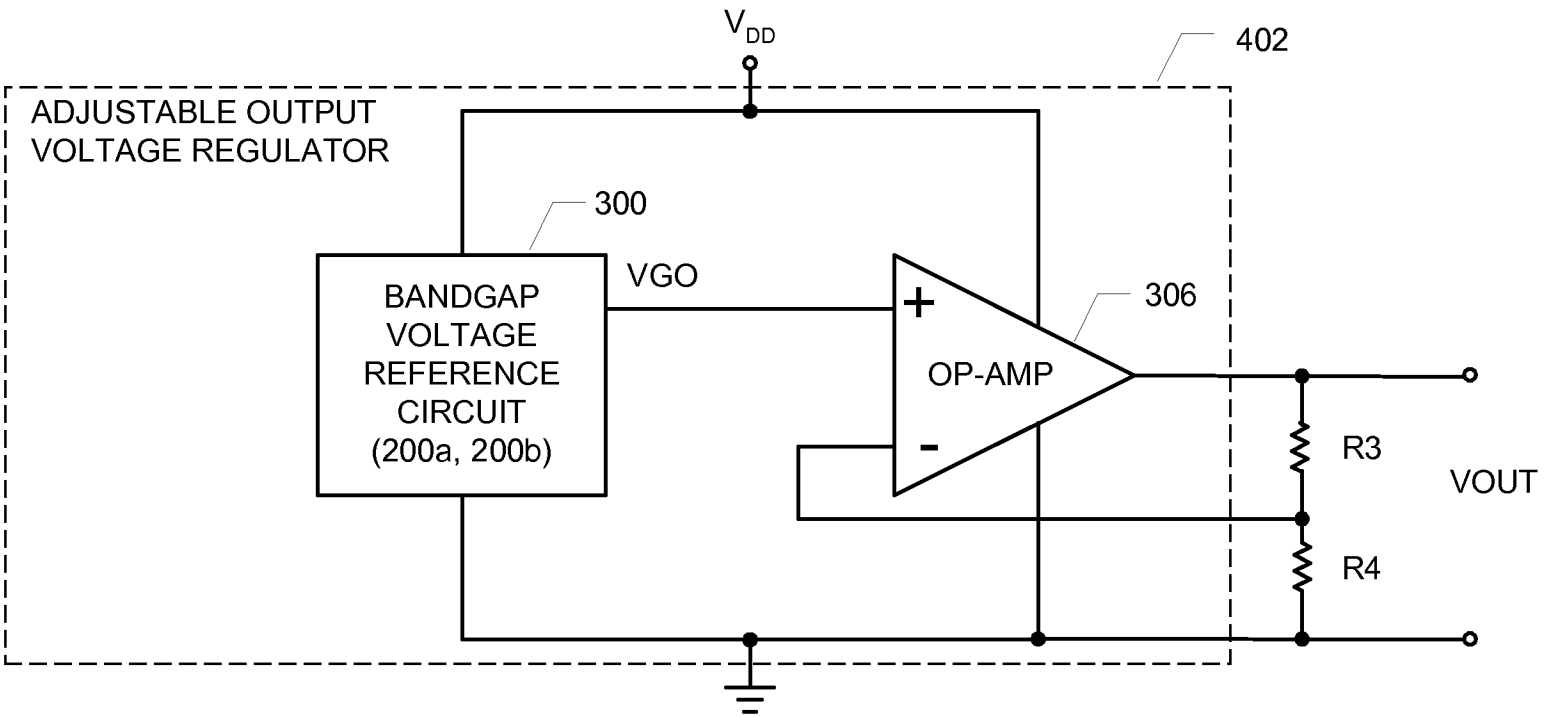
FIG. 4 is a block diagram of an exemplary adjustable output linear voltage regulator that includes a low-drift bandgap voltage reference circuit according to an embodiment of the present invention.

FIG. 4 is a block diagram of an exemplary adjustable output linear voltage regulator 402 that includes a low-drift bandgap voltage reference circuit 300 according to an embodiment of the present invention described above (e.g., 200*a*, 200*b*). As can be appreciated from FIG. 4, VOUT≈VGO*(1+R3/R4). Thus, by selecting the appropriate values for resistors R3 and R4, the desired VOUT can be selected. The resistors R3 and R4 can be within the regulator, or external to the regulator. One or both resistors can be programmable or otherwise adjustable.

Figure 5:
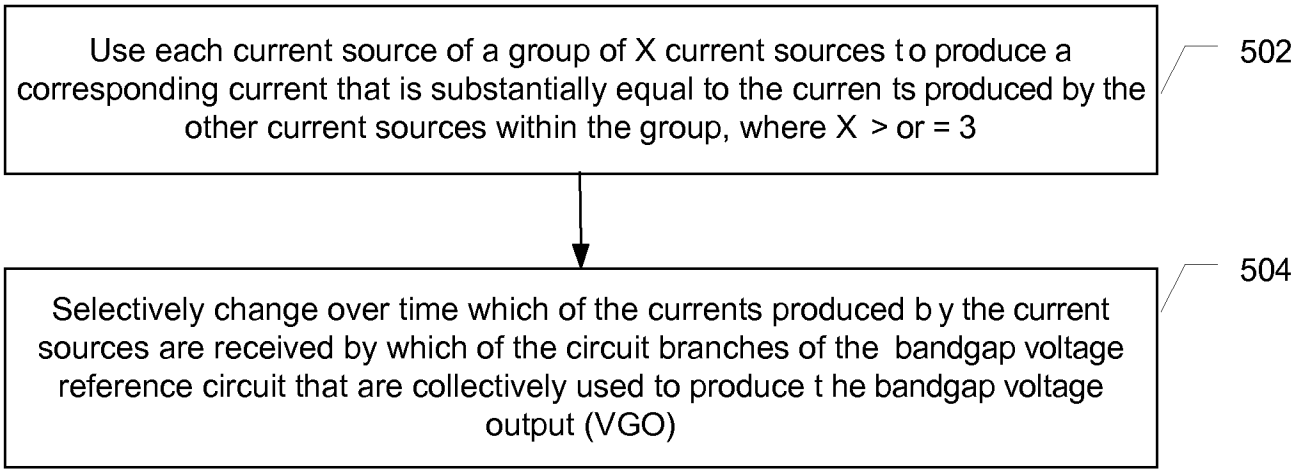
FIG. 5 is a high level flow diagram that is used to summarize a method for providing a low-drift bandgap voltage reference circuit according to an embodiment of the present invention.

FIG. 5 is a high level flow diagram that is used to summarize a method for providing a low-drift bandgap voltage reference circuit according to an embodiment of the present invention. Such a method is for use with a bandgap voltage reference circuit that produces a bandgap voltage output (VGO), wherein the bandgap voltage reference circuit includes a plurality of circuit branches (e.g., an "N" branch, a "1" branch and a "CTAT" branch) that are collectively used to produce the bandgap voltage output (VGO). Referring to FIG. 5, as indicated at step 502, each current source of a group of X current sources is used to produce a corresponding current that is substantially equal to the currents produced by the other current sources within the group, where X≧3. As indicated at step 504, over time there is a selective changing of which of the currents produced by the current sources are received by which of the circuit branches of the bandgap voltage reference circuit that are collectively used to produce the bandgap voltage output (VGO). This reduces the affects that the long-term drift of the current sources have on the bandgap voltage output (VGO), thereby making the bandgap voltage output (VGO) more stable. Additionally, this reduces the 1/F noise. Additional details of this and other methods can be appreciated from the above description FIGS. 1-4.

While in the FIGS. the diode connected transistors are shown as being NPN transistors, they can alternatively be diode connected PNP transistors. Further, while in FIG. 2A each current source is shown as being implemented using a single PMOS transistor, the current sources can alternatively be implemented using PNP transistors, or cascoded current sources including multiple PMOS or PNP transistors, as can be appreciated from the more general FIG. 2B. These are just a few examples, which are not meant to be limiting.

While in the FIGS. the current sources are shown as being connected to the high voltage rail, that is not necessary. For example, in alternative embodiments, the current sources can be connected between the diode connected transistors and the low voltage rail, e.g., ground, to thereby cause Iptat to equivalently flow through each branch. Such embodiments are also within the scope of the present invention. Further, even though in these alternative embodiments the current Iptat may be considered to be "sunk" instead of "sourced", the devices used to cause the flow of Iptat will still be referred to as current sources.

The foregoing description is of the preferred embodiments of the present invention. These embodiments have been provided for the purposes of illustration and description, but are not intended to be exhaustive or to limit the invention to the precise forms disclosed. Many modifications and variations will be apparent to a practitioner skilled in the art. Embodiments were chosen and described in order to best describe the principles of the invention and its practical application, thereby enabling others skilled in the art to understand the invention. Slight modifications and variations are believed to be within the spirit and scope of the present invention. It is intended that the scope of the invention be defined by the following claims and their equivalents.

What is claimed is:

1. A bandgap voltage reference circuit to produce a bandgap voltage output (VGO), comprising:

a group of X current sources each of which produces a corresponding current that is substantially equal to the currents produced by the other current sources within the group, where X≧3;

a plurality of circuit branches of the bandgap voltage reference circuit including first and second circuit branches used to produce a voltage proportional to absolute temperature (VPTAT), and a third circuit branch used to produce a voltage complementary to absolute temperature (VCTAT), wherein the VPTAT and the VCTAT are collectively used to produce the bandgap voltage output (VGO), and wherein each of the first, second and third circuit branches includes one or more transistors that produce base-to-emitter voltage drops used to produce the VPTAT or the VCTAT; and a plurality of switches adapted to selectively rotate each of the current sources into and out of each of the first, second and third circuit branches to thereby selectively change over time which of the current sources provide current to the first circuit branch, which of the current sources provide current to the second circuit branch, and which of the current sources provide current to the third circuit branch;

wherein the current sources are separate components from the switches and separate components from the transistors that produce the base-to-emitter voltage drops.

2. The bandgap voltage reference circuit of claim 1, wherein the current produced by each of the X current sources is received by the first circuit branch about 1/Xth of the time, by the second circuit branch about 1/Xth of the time, and by the third circuit branch about 1/Xth of the time.

3. The bandgap voltage reference circuit of claim 1, wherein X=3.

4. The bandgap voltage reference circuit of claim 1, wherein X>3.

5. The bandgap voltage reference circuit of claim 1, wherein at any given time, at least one of the currents produced by at least one of the current sources is not received by any of the circuit branches which are collectively used to produce the bandgap voltage output (VGO), even though at other times said at least one of the currents produced by said at least one of the current sources is received by the circuit branches which are collectively used to produce the bandgap voltage output (VGO).

6. The bandgap voltage reference circuit of claim 1, wherein:

at least one of the plurality of circuit branches which are collectively used to produce the bandgap voltage output (VGO) receives at least two of the currents produced by at least two of the X current sources.

7. The bandgap voltage reference circuit of claim 1, wherein:

the first circuit branch includes one diode-connected transistor;

the second circuit branch includes a resistor, and

N diode-connected transistors connected in parallel; and the third circuit branch includes a further resistor, and one diode-connected transistor.

8. The bandgap reference circuit of claim 7, further comprising an amplifier including:

an inverting (−) input that receives a first voltage produced by the first circuit branch;

a non-inverting (+) input that receives a second voltage produced by the second circuit branch; and an output that biases each of the X current sources so that each of the X current sources produces the current that is substantially equal to the currents produced by the other current sources.

9. The bandgap reference circuit of claim 1, further comprising:

a controller to control the switches.

10. A method for use with a bandgap voltage reference circuit that produces a bandgap voltage output (VGO), wherein the bandgap voltage reference circuit comprises a plurality of circuit branches including first and second circuit branches used to produce a voltage proportional to absolute temperature (VPTAT), and a third circuit branch used to produce a voltage complementary to absolute temperature (VCTAT), wherein the VPTAT and the VCTAT are collectively used to produce the bandgap voltage output (VGO), the method comprising:

(a) using each current source of a group of X current sources to produce a corresponding current that is substantially equal to the currents produced by the other current sources within the group, where X≧3; and (b) selectively rotating each of the current sources into and out of each of the first, second and third circuit branches, thereby selectively changing over time which of the current sources provide current to the first circuit branch, which of the current sources provide current to the second circuit branch, and which of the current sources provide current to the third circuit branch.

11. The method of claim 10, wherein:

the selectively rotating is performed such that the current produced by each of the X current sources is received about 1/Xth of the time by each of the plurality of circuit branches that are collectively used to produce the bandgap voltage output (VGO).

12. The method of claim 11, wherein X=3.

13. The method of claim 11, wherein X>3.

14. A voltage regulator, comprising:

a bandgap voltage reference circuit to produce a bandgap voltage output (VGO); and an operation amplifier including a non-inverting (+) input that receives the bandgap voltage output (VGO), an inverting (−) input, and an output that produces the voltage output (VOUT) of the voltage regulator;

wherein the bandgap voltage reference circuit includes a group of current sources each of which produces a corresponding current that is substantially equal to the currents produced by the other current sources within the group;

a plurality of circuit branches of the bandgap voltage reference circuit including first and second circuit branches used to produce a voltage proportional to absolute temperature (VPTAT), and a third circuit branch used to produce a voltage complementary to absolute temperature (VCTAT), wherein the VPTAT and the VCTAT are collectively used to produce the bandgap voltage output (VGO), and wherein each of the first, second and third circuit branches includes one or more transistors that produce base-to-emitter voltage drops used to produce the VPTAT or the VCTAT; and a plurality of switches adapted to selectively rotate each of the current sources into and out of each of the first, second and third circuit branches to thereby selectively change over time which of the current sources provide current to the first circuit branch, which of the current sources provide current to the second circuit branch, and which of the current sources provide current to the third circuit branch;

wherein the current sources are separate components from the switches and separate components from the transistors that produce the base-to-emitter voltage drops.

15. The voltage regulator of claim 14, wherein the inverting (−) input of the operational amplifier is connected to the output of the operation amplifier.

16. The voltage regulator of claim 15, wherein the voltage regulator comprises a fixed output linear voltage regulator.

17. The voltage regulator of claim 14, further comprising:

a resistor divider to produce a further voltage in dependence on the voltage output (VOUT) of the voltage regulator;

wherein the inverting (−) input of the operational amplifier receives the further voltage produced by the resistor divider.

18. The voltage regulator of claim 17, wherein the voltage regulator comprises an adjustable output linear voltage regulator.

19. The voltage regulator of claim 14, further comprising:

a controller to control the switches.

* * * * *